US006745905B2

(12) United States Patent
Bernstein

(10) Patent No.: US 6,745,905 B2
(45) Date of Patent: Jun. 8, 2004

(54) VENTILATED TRAY FOR REFRIGERATOR BEVERAGE PACKAGES

(75) Inventor: David Bernstein, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/284,789

(22) Filed: Oct. 31, 2002

(65) Prior Publication Data

US 2004/0084390 A1 May 6, 2004

(51) Int. Cl.[7] ..... A47F 7/28
(52) U.S. Cl. ..... 211/59.2
(58) Field of Search ..... 211/59.2

(56) References Cited

U.S. PATENT DOCUMENTS 3,662,898 A * 5/1972 Baxendale ..... 211/59.2
4,416,380 A * 11/1983 Flum ..... 211/59.2
4,651,883 A * 3/1987 Gullett et al. ..... 211/59.2
4,782,959 A * 11/1988 Kral et al. ..... 211/59.2
5,134,942 A * 8/1992 Turnwald ..... 108/24
5,645,176 A * 7/1997 Jay ..... 211/59.2
5,788,090 A * 8/1998 Kajiwara ..... 211/59.2
6,497,326 B1 * 12/2002 Osawa ..... 211/59.2
6,554,159 B1 * 4/2003 Behr et al. ..... 312/45
2002/0179553 A1 * 12/2002 Squitieri ..... 211/59.2
2003/0132178 A1 * 7/2003 Jay et al. ..... 211/59.2

* cited by examiner

*Primary Examiner*—Daniel P. Stodola
*Assistant Examiner*—Erica B Harris
(74) *Attorney, Agent, or Firm*—John L. James

(57) ABSTRACT

A refrigerator tray holds containers of individual beverages for dispensing the beverages one at a time. The tray has a ventilated support panel surrounded about its periphery by a frame of sidewalls. The support panel fits in the sidewalls so that the panel slants downward toward the front to gravity feed the beverages.

17 Claims, 3 Drawing Sheets

VENTILATED TRAY FOR REFRIGERATOR BEVERAGE PACKAGES

TECHNICAL FIELD OF THE INVENTION

This invention relates to a refrigerator shelf device, and, more particularly, to a tray for a refrigerator shelf for holding a beverage package having multiple individual beverage containers.

BACKGROUND OF THE INVENTION

Beverages occupy precious space in a refrigerator. To conserve space, individual beverage containers are packaged in a carton so that individual beverage containers are stacked vertically to conserve shelf space. For consumer appeal and economy, cartons typically contain 12, 18, 20 or 24 individual beverage containers. The cartons rest on a side to make maximum use of shelf space. Unfortunately, the cartons lie flat on one side thereby losing benefit of gravity feed when only one row of containers remains to be dispensed. It is desirable to retain gravity feed to ensure that containers are easily dispensed.

Typically, popular upscale residential refrigerators have glass shelves wherein the glass is flat, without openings or ribs, so that there is no air circulation through the glass shelf or over the surface between the carton and shelf surface. Ventilation is essential to timely chill the beverage containers and to keep them chilled. Accordingly, it will be appreciated that it would be highly desirable to have a shelf device that not only ensures gravity feed but also facilitates ventilation of the beverage carton.

A full carton rests flat on the shelf and individual beverage containers gravity feed for removal one at a time. When only one row or layer of containers remains, the gravity feed is lost. As the containers are removed, the center of gravity shifts which may cause the carton to tip forward or move about on the shelf. Also, moisture on the shelf reduces friction between the carton and shelf increasing the tendency of the carton to move about on the shelf. It is desirable to maintain the carton in a fixed position on the shelf.

SUMMARY OF THE INVENTION

The present invention is directed to overcoming one or more of the problems set forth above. Briefly summarized, according to the present invention, a tray for a refrigerator shelf has four sidewalls and a support panel. A front sidewall has a top portion and a bottom portion, and a rear sidewall has a top portion and a bottom portion with the rear sidewall spaced from the front sidewall. The bottom portion of the front sidewall is at a lower elevation than the top portion of the rear sidewall. A left sidewall has a top portion and a bottom portion, and a right sidewall has a top portion and a bottom portion. The right sidewall is spaced from the left sidewall. The bottom portions of the left and right sidewalls are at a lower elevation than the top portions of the left and right sidewalls. The support panel has front, rear, left and right edges with the front edge connected to the bottom portion of the front sidewall and with the rear edge connected to the top portion of the rear sidewall. The left edge is connected to the left sidewall and the right edge is connected to the right sidewall so that the support. panel slants downward from the rear sidewall towards the front sidewall.

Slanting the support panel towards the front sidewall ensures that a carton resting on the tray will have individual beverage containers inside the carton gravity feed toward the front sidewall for dispensing one at a time.

The left, right and front sidewalls define a retaining lip above the support panel which retains the carton on the tray. The left, right and rear sidewalls define a retaining lip below the support panel, which, when upturned, retains the carton on the tray. When the upper retaining lip and the lower retaining lip are of different width dimensions, different sizes of cartons are easily accommodated by a single tray.

The support panel defines a plurality of ventilation openings to provide for adequate ventilation. Also, the sidewalls have openings that provide effective ventilation when the tray rests on a glass shelf.

According to another aspect of the invention, a tray has a bottom panel with front, rear, left and right upstanding sidewalls. A plurality of support members each have their front ends connected to the bottom portion of the front sidewall and their rear ends connected to the top portion of the rear sidewall so that the support members slant downward from the rear sidewall towards the front sidewall. The bottom panel has openings to provide ventilation.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
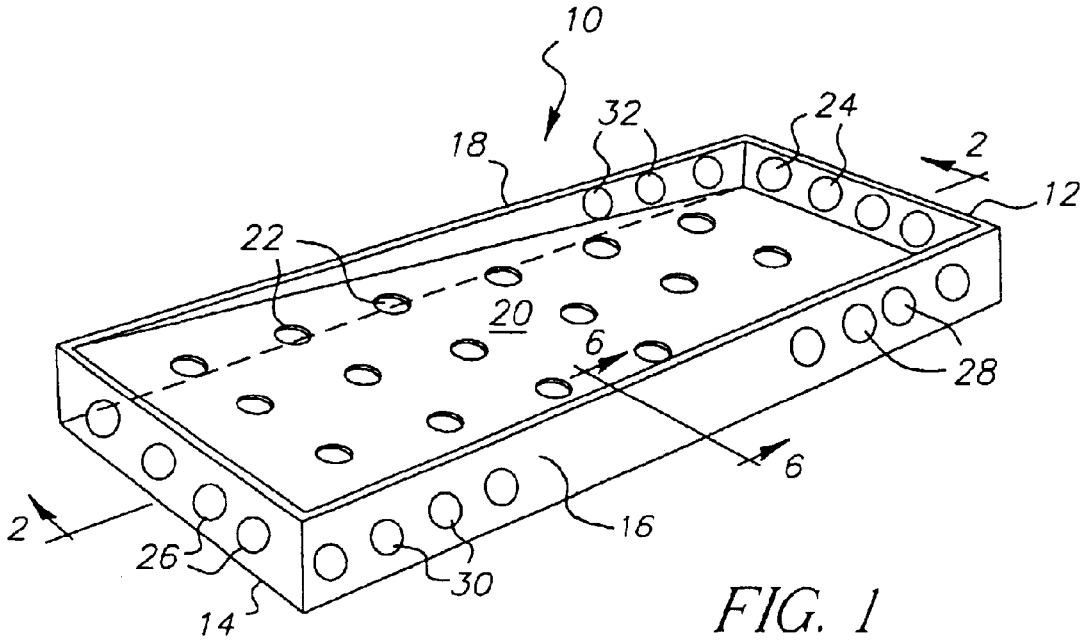
FIG. 1 is a perspective view of a preferred embodiment of a refrigerator tray for beverage cartons according to the present invention.
Figure 2:
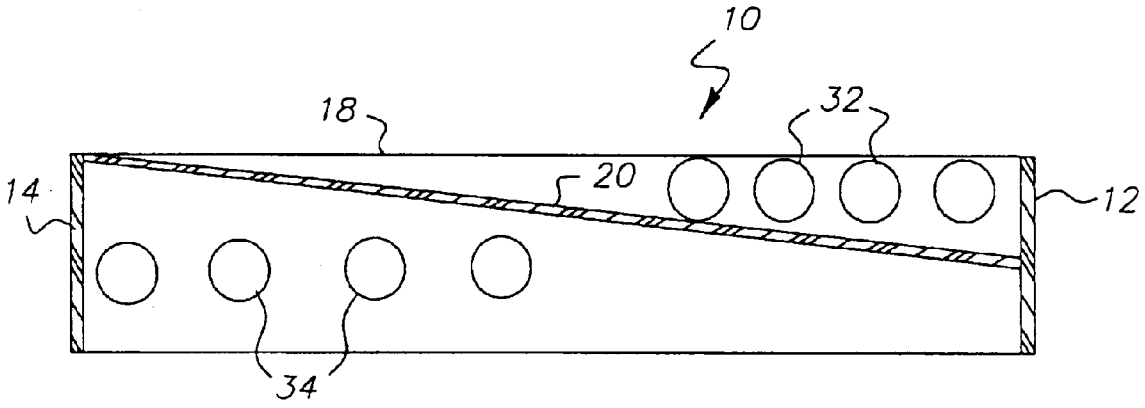
FIG. 2 is a longitudinal sectional view of the tray of FIG. 1 taken along line 2—2 of FIG. 1.

Referring to FIGS. 1–2, a tray 10 for holding a carton of individual beverage containers gravity feeds the containers for dispensing one at a time. The tray 10 has front and rear sidewalls 12, 14 each with a top portion and a bottom portion. Front and rear sidewalls 12, 14 are spaced from one another. The bottom portion of front sidewall 12 is at a lower elevation than the top portion of the rear sidewall 14.

Tray 10 also has left and right sidewalls 16, 18 spaced from one another with each having a top portion and a bottom portion. The bottom portions of left and right sidewalls 16, 18 are at a lower elevation than the top portions of the left and right sidewalls 16, 18.

A support panel 20 has front, rear, left and right edges. The front edge is connected to the bottom portion of front sidewall 12, the rear edge is connected to the top portion of the rear sidewall 14, the left edge is connected to the left sidewall 16, and the right edge is connected to the right sidewall 18. The support panel 20 preferably slants downward from rear sidewall 14 towards front sidewall 12. Support panel 20 has a plurality of openings 22 to help with air circulation.

Front sidewall 12 preferably has a plurality of openings 24 formed in its top portion so that the openings lie above support panel 20 as illustrated in FIG. 1, but which would lie below support panel 20 if the tray were turned over so that the top becomes the bottom and the bottom becomes the top. Similarly, rear sidewall 14 preferably has a plurality of openings 26 formed in its bottom portion so that the openings 26 lie below support panel 20 as illustrated in FIG. 1, but which would lie above support panel 20 if the tray were turned over so that the top becomes the bottom and the bottom becomes the top. Left sidewall 16 contains a first set of openings 28 near the front sidewall 12 of the tray lying above support panel 20, and has a second set of openings 30 near the rear sidewall 14 of the tray lying below support panel 20. Right sidewall 18 has sets of similar openings 32, 34.

The left, right and front sidewalls 16, 12, 18 define a retaining lip above support panel 20 at the front of the tray. The retaining lip prevents a beverage carton from sliding off the tray. The lip need not be a very pronounced lip; it only has to be sufficiently deep to prevent the carton from sliding off the tray, but not so deep as to interfere with removing individual beverage containers from the carton through an opening at the bottom front of the carton. Where the tray is dimensioned to exactly fit a particular carton, then rear sidewall 14 may be used to complete the lip forming a complete rim, as is the case with the portions of the tray below support panel 20 in FIG. 2. Where the tray is shorter than the carton, then rear sidewall 14 does not form part of the lip thereby allowing the carton to overhang the tray, as is the case with the portions of the tray above support panel 20 in FIG. 2.

In similar fashion, the rear, left and right sidewalls 14, 16, 18, define a retaining lip below support panel 20 which can be used for a carton when the tray is turned upside down. Preferably, left and right sidewalls 16, 18 are thicker or offset inward to make the spacing between them narrower, or, alternatively, may be offset outward to make the spacing wider, to accommodate a different carton width.

Figure 3:
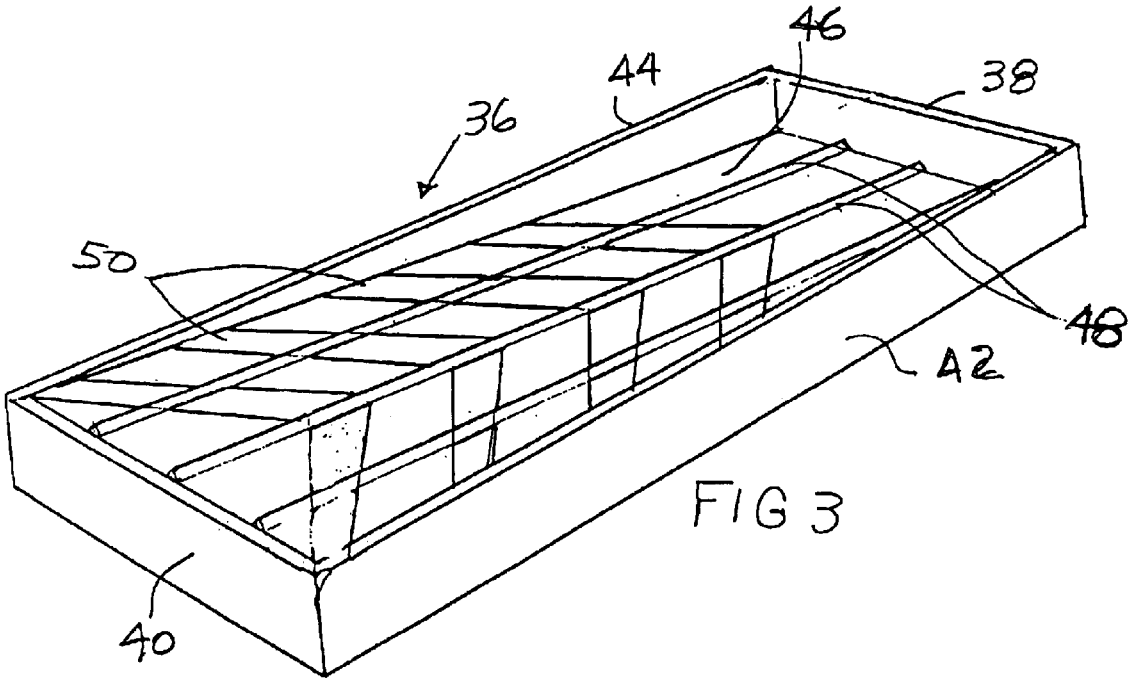
FIG. 3 is a perspective view of another preferred embodiment of a refrigerator tray for beverage cartons according to the present invention.

Referring to FIG. 3, a tray 36 for holding articles, such as a carton of beverages for example, has a front sidewall 38 with a top portion and a bottom portion and a rear sidewall 40 with a top portion and a bottom portion. The rear sidewall 40 is spaced from the front sidewall 38 and the bottom portion of the front sidewall lies at a lower elevation than the top portion of the rear sidewall. A left sidewall 42 has top and a bottom portions, and a right sidewall 44 has top and bottom portions. Right sidewall 44 is spaced from left sidewall 42, and the bottom portions of the left and right sidewalls lie at lower elevations than the top portions. A bottom wall 46 is connected to the front, rear, left and right sidewalls.

A plurality of support members 48 each have front and rear ends. The front ends are connected to the bottom portion of the front sidewall 38, and the rear ends are connected to the top portion of the rear sidewall 40. The support members 48 slant downward from the rear sidewall 40 towards the front sidewall 38. Each support member 48 may be a simple elongated member such as a rod, or may be a panel. Where rods are employed, the bottom panel may be omitted so that the tray can be turned upside down to accommodate a different size carton so that a single tray can accommodate different sizes of cartons. Where panels instead of rods are employed, the bottom panel 46 may have a plurality of openings 50 to promote air circulation.

Preferably, the left, right and front sidewalls 42, 44, 38 define a retaining lip above the support members 48. Where rods are used without a bottom panel, the left, right and rear sidewalls 42, 44, 40 define a retaining lip below the support members 48 for use when the tray is turned upside down.

Figure 4:
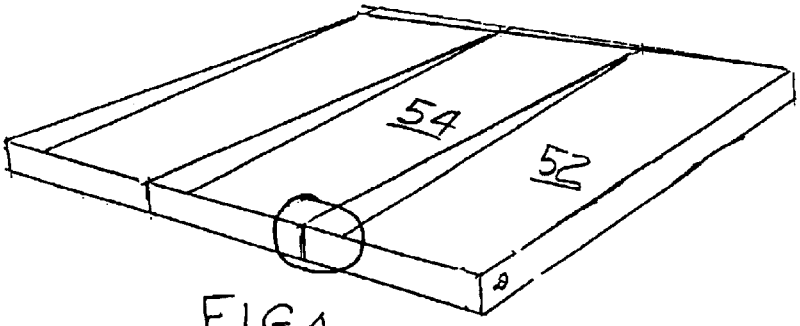
FIG. 4 is a diagrammatic perspective view of several trays connected side by side to one another.
Figure 5:
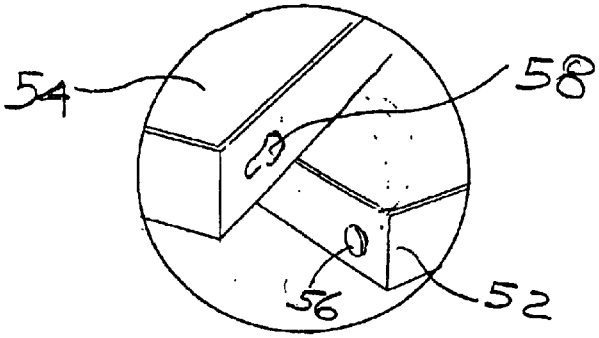
FIG. 5 is a somewhat enlarged exploded view of the encircled portion of FIG. 4.

Referring to FIGS. 4–5, adjacent trays 52, 54, may be connected side by side using connecting means such as, for example, a key 56 on tray 52 to interlock with a keyway 58 on tray 54.

Figure 6:
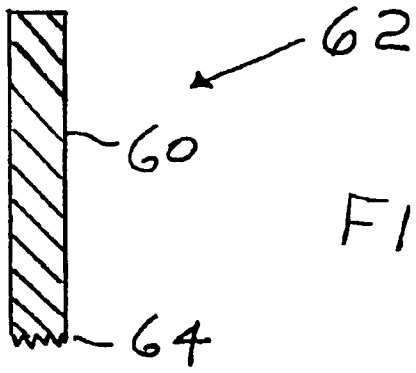
FIG. 6 is a diagrammatic sectional view of tray sidewall which has a serrated bottom edge.

FIGS. 6–9 illustrate fastening means for preventing movement of a tray on a shelf. In FIG. 6, a sidewall 60 of a tray 62 is equipped with a grooved or serrated bottom edge 64. A series of horizontal and transverse grooves produce a pattern of feet for contacting the surface of the shelf to thereby increase friction to resist movement of the tray on the shelf. The grooves provide an escape path for moisture so that the feet can have fiction producing contact with the shelf.

Figure 7:
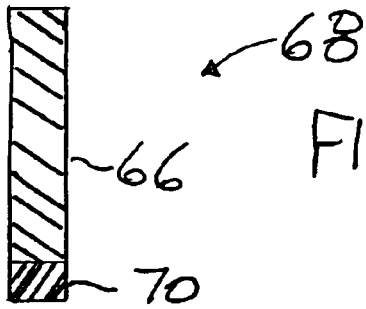
FIG. 7 is a diagrammatic sectional view of tray sidewall similar to FIG. 6 but illustrating a rubber strip attached to the bottom edge.
Figure 8:
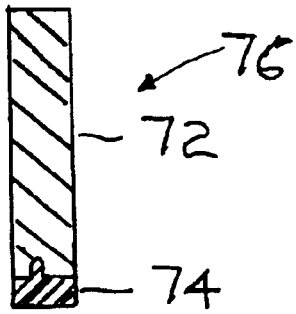
FIG. 8 is a diagrammatic sectional view of tray sidewall similar to FIGS. 6 and 7 but illustrating a key and keyway attaching a rubber strip to the bottom edge.

FIG. 7 illustrates another means for fastening a sidewall 66 of a tray 68 to a shelf. The fastening means includes an elastomeric strip 70, preferably rubber or the like, attached to the bottom edge of the sidewall 66 with an adhesive or the like. A mechanical fastener could be used, but an adhesive is preferred because it is simple and easy to use. In FIG. 8, the bottom edge of a sidewall 72 of tray 76 has a groove or keyway which accepts a tongue or key of an elastomeric strip 74. Elastomeric strips 70 and 74 may extend continuously about the entire bottom edge of a tray, or may be a series of pieces of material.

Figure 9:
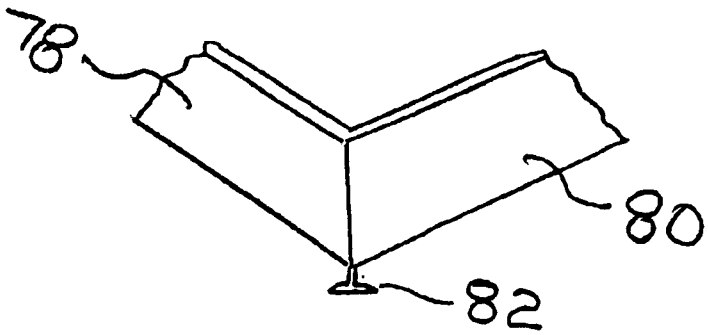
FIG. 9 is a diagrammatic fragmentary view of a corner of a tray with a suction cup attached.

FIG. 9 illustrates a corner of a tray formed by sidewalls 78 and 80. A suction cup 82 is attached to the bottom of the tray at the corner to prevent the tray from moving about on the shelf. The corner may have a protrusion extending downward for attaching the suction cup or may have bore to receive a pin for attaching the suction cup. Suction cups can be used at locations other than the corners.

While the invention has been described with particular reference to the preferred embodiments, it will be understood by those skilled in the art that various changes may be made and equivalents may be S substituted for elements of the preferred embodiments without departing from invention. For example, while the tray can be molded of plastic, metal could also be used. Also, upstanding ribs can be added to the support panel to further foster air circulation.

As is evident from the foregoing description, certain aspects of the invention are not limited to the particular details of the examples illustrated, and it is therefore contemplated that other modifications and applications will occur to those skilled in the art. For instance, because the upper and lower lips accept a carton, the lips can reinforce the front of the carton. Cartons can be stood on end and two cartons used on a single tray. Also, trays can be placed between cartons on a transportation pallet and shipped with the carton. It is accordingly intended that the claims shall cover all such modifications and applications as do not depart from the true spirit and scope of the invention.

What is claimed is:

1. A tray for a refrigerator shelf, comprising:

a front sidewall having a top portion and a bottom portion;

a rear sidewall having a top portion and a bottom portion, said rear sidewall defining a plurality of ventilation openings, said rear sidewall being spaced from said front sidewall, said bottom portion of said front sidewall being at a lower elevation than said top portion of said rear sidewall;

a left sidewall having a top portion and a bottom portion;

a right sidewall having a top portion and a bottom portion, said right sidewall being spaced from said left sidewall, said bottom portions of said left and right sidewalls being at a lower elevation than said top portions of said left and right sidewalls; and a support panel having front, rear, left and right edges, said front edge being connected to said bottom portion of said front sidewall, said rear edge being connected to said top portion of said rear sidewall, said left edge being connected to said left sidewall, said right edge being connected to said right sidewall so that said support panel slants downward from said rear sidewall towards said front sidewall, said support panel being oriented above said plurality of ventilation openings.

2. A tray as set forth in claim 1, wherein said left, right and front sidewalls define a retaining lip above said support panel.

3. A tray as set forth in claim 2, wherein said left, right and rear sidewalls define a retaining lip below said support panel.

4. A tray, as set forth in claim 1, wherein said support panel defines a plurality of ventilation openings.

5. A tray, as set forth in claim 1, wherein said top portion of said front sidewall defines a plurality of ventilation openings.

6. A tray, as set forth in claim 1, including means, attached to said tray, for fastening said tray to the shelf.

7. A tray, as set forth in claim 1, wherein said bottom portions of said left and right sidewalls define a plurality of ventilation openings.

8. A tray for a refrigerator shelf, comprising:

a front sidewall having a top portion and a bottom portion;

a rear sidewall having a top portion and a bottom portion, said rear sidewall defining a plurality of ventilation openings, said rear sidewall being spaced from said front sidewall, said bottom portion of said front sidewall being at a lower elevation than said top portion of said rear sidewall;

a left sidewall having a top portion and a bottom portion;

a right sidewall having a top portion and a bottom portion, said right sidewall being spaced from said left sidewall, said bottom portions of said left and right sidewalls being at a lower elevation than said top portions of said left and right sidewalls; and at least one support member having front and rear ends, said front end being connected to said bottom portion of said front sidewall, said rear end being connected to said top portion of said rear sidewall, said support member slanting downward from said rear sidewall towards said front sidewall, said support member being oriented above said plurality of ventilation openings.

9. A tray as set forth in claim 8, wherein said left, right and front sidewalls define a retaining lip above said support member.

10. A tray as set forth in claim 9, wherein said left, right and rear sidewalls define a retaining lip below said support member.

11. A tray, as set forth in claim 8, including a bottom panel connected to said front, rear, left and right sidewalls, said bottom panel defining a plurality of ventilation openings.

12. A tray, as set forth in claim 8, including means, attached to said tray, for fastening said tray to the shelf.

13. A tray device for a refrigerator shelf, comprising:

a first tray comprising a front sidewall having a top portion and a bottom portion; a rear sidewall having a top portion and a bottom portion, said rear sidewall defining a plurality of ventilation openings, said rear sidewall being spaced from said front sidewall, said bottom portion of said front sidewall being at a lower elevation than said top portion of said rear sidewall; a left sidewall having a top portion and a bottom portion; a right sidewall having a top portion and a bottom portion, said right sidewall being spaced from said left sidewall, said bottom portions of said left and right sidewalls being at a lower elevation than said top portions of said left and right sidewalls; and at least one support member having front and rear ends, said front end being connected to said bottom portion of said front sidewall, said rear end being connected to said top portion of said rear sidewall, said support member slanting downward from said rear sidewall towards said front sidewall and slanting downward from rear to front along said left and right sidewalls such that said support member is oriented above said ventilation openings;

second tray comprising a front sidewall having a top portion and a bottom portion; a rear sidewall having a top portion and a bottom portion, rear sidewall defining a plurality of ventilation openings, said rear sidewall being spaced from said front sidewall, said bottom portion of said front sidewall being at a lower elevation than said top portion of said rear sidewall; a left sidewall having a top portion and a bottom portion; a right sidewall having a top portion and a bottom portion, said right sidewall being spaced from said left sidewall, said bottom portions of said left and right sidewalls being at a lower elevation than said top portions of said left and right sidewalls; and at least one support member having front and rear ends, said front end being connected to said bottom portion of said front sidewall, said rear end being connected to said top portion of said rear sidewall, said support member slanting downward from said rear sidewall towards said front sidewall and slanting downward from rear to front along said left and right sidewalls such that said support member is oriented above said ventilation openings; and means for connecting said first and second trays to one another.

14. A tray device, as set forth in claim 13, wherein said connecting means includes a key on said first tray mateable with a keyway on said second tray.

15. A tray for a refrigerator shelf, said tray having a top and a bottom, said tray comprising:

a front sidewall having a top portion and a bottom portion;

a rear sidewall having a top portion and a bottom portion, said rear sidewall being spaced from said front sidewall, said bottom portion of said front sidewall being at a lower elevation than said top portion of said rear sidewall;

a left sidewall having a top portion and a bottom portion;

a right sidewall having a top portion and a bottom portion, said right sidewall being spaced from said left sidewall, said bottom portions of said left and right sidewalls being at a lower elevation than said top portions of said left and right sidewalls; and a support panel having front, rear, left and right edges, said front edge being connected to said bottom portion of said front sidewall, said rear edge being connected to said top portion of said rear sidewall, said left edge being connected to said left sidewall, said right edge being connected to said right sidewall, said support panel slanting downward from said rear sidewall towards said front sidewall and slanting downward from rear to front along said left and right sidewalls, said tray being reversible so that said top becomes said bottom and said bottom becomes said top.

16. A tray as set forth in claim 15, wherein said left, right and front sidewalls define a retaining lip above said support panel.

17. A tray as set forth in claim 15, wherein said left, right and rear sidewalls define retaining lips above and below said support panel.

* * * * *